US005095983A

United States Patent [19]

Magnani

[11] Patent Number: 5,095,983

[45] Date of Patent: Mar. 17, 1992

[54] MULTIPHASE PRODUCTION EVALUATION METHOD USING THRU-TUBING, WIRELINE PACKOFF DEVICES

[75] Inventor: Charles F. Magnani, Placentia, Calif.

[73] Assignee: Chevron and Research and Technology Company, San Francisco, Calif.

[21] Appl. No.: 591,906

[22] Filed: Oct. 2, 1990

[51] Int. Cl.[5] ..... E21B 49/00; E21B 43/14; E21B 43/134

[52] U.S. Cl. ..... 166/250; 166/113; 166/267; 166/369; 166/387; 73/155; 73/196

[58] Field of Search ..... 166/250, 264, 357, 267, 166/113, 184, 131, 369, 370; 73/155, 195, 196

[56] References Cited

U.S. PATENT DOCUMENTS

| | | | |
|---|---|---|---|
| 2,751,016 | 6/1956 | Watzlavick | 166/264 |
| 2,945,952 | 7/1960 | Bourne et al. | 73/155 |
| 3,083,774 | 4/1963 | Peters et al. | 166/250 |
| 3,103,812 | 9/1963 | Bourne, Jr. et al. | 73/155 |
| 3,371,527 | 3/1968 | Moulin | 166/250 |
| 3,439,740 | 4/1969 | Conover | 166/250 |
| 3,876,003 | 4/1975 | Kisling, III | 166/250 |
| 3,905,226 | 9/1975 | Nicolas | 73/155 |
| 4,535,843 | 8/1985 | Jageler | 166/250 |
| 4,759,408 | 7/1988 | Buchanan | 166/278 |
| 4,803,873 | 2/1989 | Ehlig-Economides | 73/155 |
| 4,905,203 | 2/1990 | Sims et al. | 367/25 |
| 4,928,762 | 5/1990 | Mamke | 166/192 |

*Primary Examiner*—George A. Suchfield

*Attorney, Agent, or Firm*—Edward J. Keeling; David J. Power

[57] ABSTRACT

A method for providing improved measurement of oil, water, and gas flow rates in producing wells using thru-tubing wireline inflatable and retrievable packers or plugs to systematically isolate producing zones within a wellbore. Surface flow rates are measured before and after zonal isolation, with the zonal production rate determined by the measured difference in flow rate before and after isolation. Surface measurement of individual production zones allows greater accuracy in measuring multiphase flows, while at the same time allowing evaluation of reservoir properties of the lower, isolated zones.

8 Claims, 3 Drawing Sheets

MULTIPHASE PRODUCTION EVALUATION METHOD USING THRU-TUBING, WIRELINE PACKOFF DEVICES

FIELD OF THE INVENTION

The present invention relates to well logging methods in general, and more particularly to production logging systems and methods which measure multiphase flow profiles in producing wells.

BACKGROUND OF THE INVENTION

One of the primary applications of production logging is to determine oil and water flow rates at various depths in a well. These rates are calculated by measuring values of fluid properties such as oil, water and gas velocity, density and capacitance. The accuracy of these measurements is suspect and has great impact on the accuracy of the calculated downhole flow rate.

In production logging, fluid velocity is usually measured with a "spinner-type" flowmeter. The spinner is calibrated by passing the tool through a fluid-filled wellbore at a constant speed. By successively recording the resulting spinner rotational speed and the corresponding depth location, a continuous flow-survey or fluid velocity log will be obtained. Using this survey, flow rates in the wellbore at different depths can be readily determined to prepare a representative flow profile of that well. Even though spinners have been widely used for many years and have been greatly improved, they still have many disadvantages and restrictions.

Some disadvantages of spinner flowmeters are created by mechanical problems, while others are created by the properties of the fluid and the flow which is being measured. For example, the impeller of the spinner rotates on a bearing which wears and requires frequent inspection and replacement to keep frictional effects from influencing the measurements. Additionally, the spinner requires calibration which must be done downhole, necessitating multiple logging runs at various speeds. In reference to fluid properties, the spinner speed is not only affected by changes in velocity of the fluid, but also by changes in fluid viscosity, flow regime, fluid density, and temperature and pressure.

Furthermore, fluid properties in general have a substantial impact on the accuracy of all production log-derived profile techniques, especially in the measurement of multiphase fluid flow. Quantitative analyses of these multiphase flows are extremely vulnerable to error. For example, spinner type flowmeters, as described above, and basket type flowmeters, while functioning well in single phase flow, are ineffective in multiphase flow due to the flow regimes inherent in such flows. These devices may be calibrated for operation in a two phase flow environment, however, such calibration cannot accurately compensate for actual flow regimes encountered in the field. Capacitance probes, used to determine the holdup fraction in gas-liquid, or liquid-liquid type flows, thereby increasing the effectiveness of the above mentioned devices, are reliable only in wells producing with watercuts under 50%. Additionally, the capacitance probe is further limited by the fact that it is unable to distinguish oil from gas, due to the variation in dielectrics. Similarly, nuclear fluid density tools, also used to increase the effectiveness of spinner and basket type devices, fail due to the inability to effectively distinguish between oil and water. Moreover, while density and capacitance tools can be calibrated for flow regime and fluid type, again such calibration will not accurately compensate for actual flow regimes encountered in field use. Additionally, once the above measurements are made, two correlations must be used to calculate individual gas, oil, and water flow rates. The accuracy of these correlations is suspect which leads to further deviation from true flow rate values. Therefore there exists in the industry a need for a simpler, more accurate method for measuring bottomhole production rates.

SUMMARY OF THE INVENTION

This invention is directed to providing an improved method to improve downhole measurement of oil, water, and gas flow rates in producing wells by a systematic isolation of zonal production. The method involves initially measuring the total, steady state well production rate at the surface of the wellbore. The well can be either a naturally flowing well or a low flow well augmented by artificial lift. A thru-tubing, wireline inflatable and retrievable plug or packer is next lowered into the wellbore and positioned above a preselected zone to isolate said zone. In the preferred embodiment an inflatable packer, as disclosed in U.S. Pat. No. 4,840,231 to Berzin et al., and specifically incorporated herein by reference, is used to isolate the zone by inflating the packer to expand it into sealing contact with the bore hole, blocking all flow beneath it. Surface flow rate is again measured, with the zonal production rate calculated as the difference of flow rate before and after isolation. The packer is then deflated, freeing it from contact with the wellbore, and is moved to another preselected location, where the above-referred to steps are repeated. This procedure is followed until the flow rates of all individual zones within the wellbore have been measured.

Packer, basket, and diverter-type flowmeters operate by diverting flow through the center of a tool containing a spinner. It is an object of the present invention to circumvent the associated complex downhole rate, density, and holdup measurements required by these devices. A feature of the present invention is the use of a packer to selectively isolate all the production from a specific zone. An advantage of the present invention is the ability to measure all flow rates at the surface, thereby eliminating numerous problems associated with downhole measurements.

DETAILED DESCRIPTION OF THE INVENTION

Figure 1:
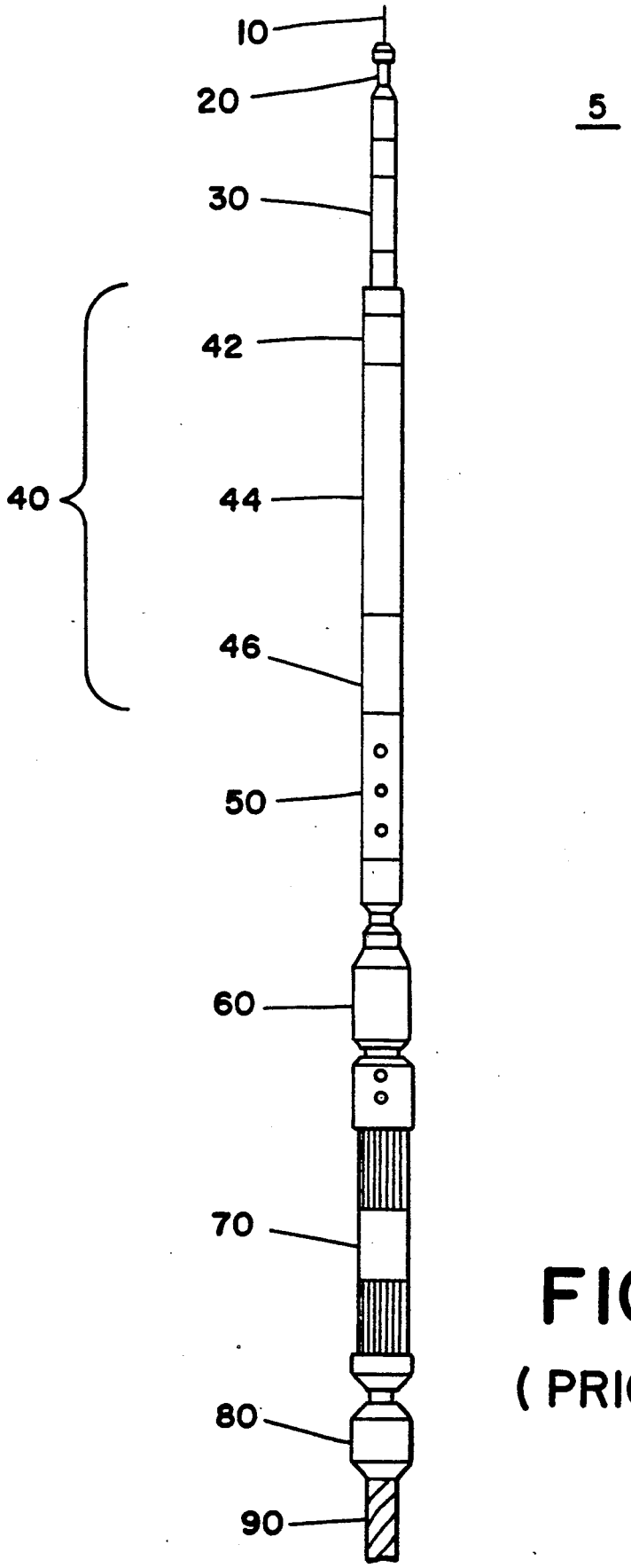
FIG 1 (PRIOR ART)
FIG. 1 shows a wireline tool setup for isolating individual production zones within the wellbore.

In FIG. 1 there is shown a wireline setting tool 5 configured for practicing the method herein and generally known in the art. As disclosed in FIG. 1 the tool is suspended from a wireline 10 which is coupled to the tool by cable head 20. Attached adjacent to cable head 20 is collar locator 30, allowing for wellbore depth measurements. Below collar locator 30 is drive section 40 for pressurizing and depressurizing packer element 70. The drive section 40 is comprised of a compensating piston section 42 for regulating pressure in multiphase flow, and motor section 44 to drive pump 46 to pump fluid into packer 70 upon pressurization. Wellbore fluid used to pressurize packer 70 is filtered to eliminate sediment contamination by filter element 50, located below drive section 40. Below filter element 50 is the hydraulic disconnect section 60, allowing for retrieval of the wire line assembly While packer 70 is maintained in situ, enabling extended evaluation of a particular producing zone. Packer 70, located below hydraulic disconnect 60, is the preferred device for isolating production zones; it is designed as an inflatable isolation means in which the inflatable element allows passage of the tool through tubing restrictions and can then be inflated and set in the casing as an anchor and seal. This same means of isolation may also be achieved using a bridge plug device interchangeably with the above-described packer, and will be described in greater detail herein. Said devices can be collapsed, retrieved, and reset at other wellbore locators. Below Packer 70 is guide 80 and pressure gauge 90. The pressure gauge 90 allows for evaluation of the reservoir properties of a lower, isolated zone; while also giving an indication of whether there is communication between the lower isolated zone and the adjacent production zone being evaluated.

Figure 2:
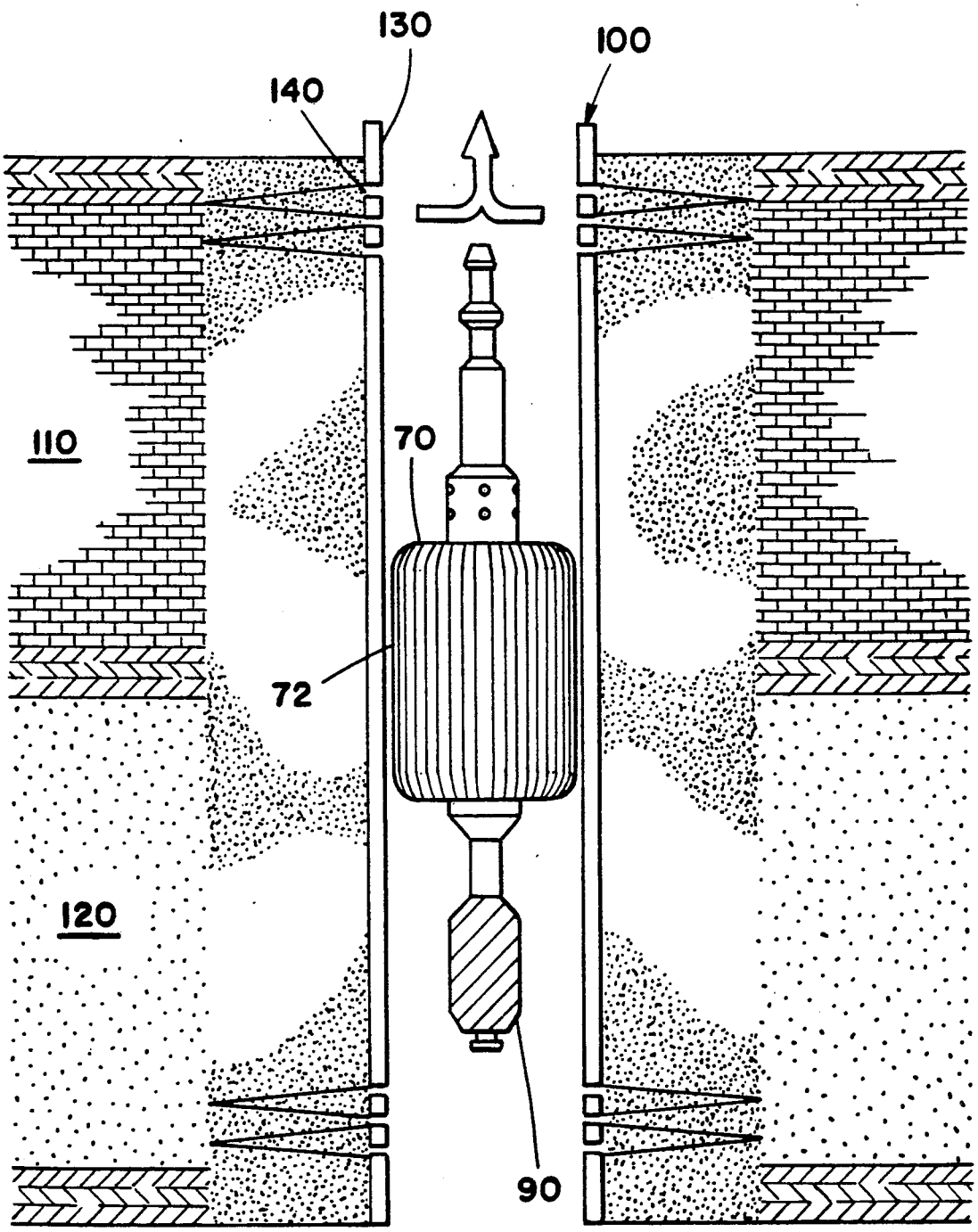
FIG. 2 shows a packer element in its operational mode, isolating a lower production zone, allowing measurement of fluid flow from an upper production zone.

In FIG. 2, Packer 70 is shown in a downhole position inside wellbore 100. This wellbore is seen as transversing two production zones, an upper zone 110, and a lower zone 120. Packer 70, as shown is in its operative condition; having been inflated with wellbore fluids by drive section 40 shown in FIG. 1, the side walls 72 of Packer 70 are sealingly engaged with casing sidewalls 130, thereby isolating lower zone 120 from upper zone 110. It is envisioned that lower zone 120 may comprise several producing zones, all isolated from upper zone 110. Casing perforations 140 in the upper zone, create a communication path for fluid in upper production zone 110, allowing said fluid ingress into and up wellbore 100 toward the surface. Packer 70, by isolating the upper zone 110, allows measurement of the upper zone production rates only. Pressure gauge 90, fixed to the lower section of Packer 70 and extending into lower zone 120, will allow for determination of reservoir properties of the lower zone, while also aiding in determining whether there is any communication between the isolated lower and non-isolated upper zones, through differential pressure readings.

Packer 70, as herein described, must be of a robust design to effectively seal the wellbore, isolating the various production zones located within the wellbore. Such a packer is disclosed in U.S. Pat. No. 4,840,231 to Berzin et al., and is specifically incorporated herein.

Figure 3:
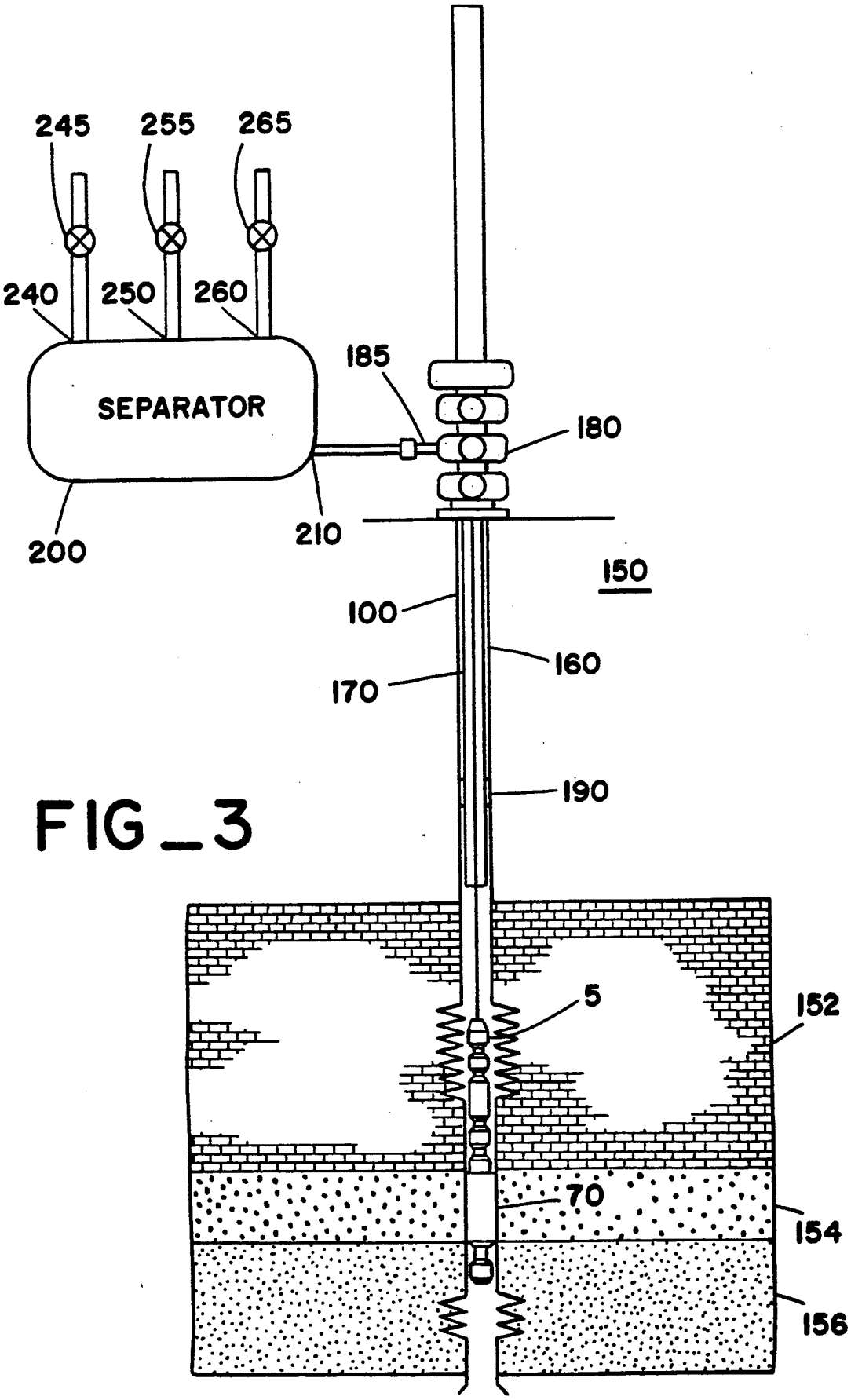
FIG. 3 shows the wireline tool in its operational mode within a formation having three production zones. The lowest production zone is isolated, allowing production fluid to flow to the surface for separation and measurement.

In FIG. 3, the operational set-up for the method of this invention is illustrated. A wellbore 100 shown transversing through a formation 150 containing a first upper producing zone 152, a second producing zone 154 located below said first zone, and a third producing zone 156 below said second zone. For brevity only a three zone formation will be discussed; however, it is recognized that multiple subsequent zones may be contained in formation 150 and analyzed as described herein. Wellbore 100 is shown as being bounded by a casing 160, and having production tubing 170 running from the surface valves 180 at the wellhead down through the casing 160 and into formation 150. Production packers 190 are fixedly placed in the annular space between production tubing 170 and casing 160 to seal this annular space, thereby making production tube 170 the only communication path for the wellbore fluid to the surface.

At surface valve 180 wellbore production fluid flows through wellhead outlet 185 and into separator inlet 210 of three phase separator apparatus 200. Gas, water, and oil are separated and each phase exits the separator at points 240, 250, and 260 respective)y for flow parameter measurements by meters 245, 255, and 265 respectively.

In the preferred embodiment, the total production rate of the production fluid within the wellbore is first measured by allowing the fluid from all production zones to pass through production tubing 170, through outlet 185 to separator inlet 210, for measurement by the three phase separator apparatus 200 located at the surface. It is recognized that the use of surface equipment, rather than downhole equipment, for measurement of production flow, yields more accurate results since equipment size is not a factor in trying to maximize accuracy.

As shown in FIG. 3, once total flow rate $Q_T$ is determined, a wireline tool 5, as depicted in FIG. 1, is lowered into wellbore 100 to the point where the lowest level production zone, herein the third zone 156, abuts the adjacent zone located above, herein the second zone 154. Packer 70 is then inflated until it sealingly engages wellbore casing 160. Production rate Q' is then measured, Q'' representing the total production rate for the wellbore absent the production rate of the lowest isolated zone. The production rate $Q_i$ for this bottom ith zone is then calculated as $$Q_i = |Q_T - Q'|$$

The packer 70 is then deflated and the wireline tool is then raised to the point where the next lowest production zone, herein the second or (i+1)th zone 154 abuts the adjacent zone located above, herein the first or (i=2)th zone 152, and packer 70 is reinflated. Production rate Q'' is then measured, Q'' representing the total production rate for the wellbore absent the production rate of the isolated first measured zone, Q', and the next lowest zone. The production rate for this next lowest zone is then calculated as $$Q_{i+1} = Q'' - Q'|$$

with the first production zone value given as Q'' in the three zone model described herein.

For formations having multiple production zones it is apparent that the individual zonal rates measured from the lower most production zone to the upper most production zone can be calculated using the following relationship $$Q_i = Q_T - Q_{mi} - \sum_{i=0}^{i-1} Q_i$$

where i=production zone to be measured $Q_i$=individual production zone flow rate $Q_{mi}$=surface measured rate with the ith zone isolated $Q_T$=nonisolated wellbore flow rate, sum of all production zone rates It is preferred, as herein described, to start measurements with the lowest production zone, and move progressively up the wellbore for subsequent measurements. However, it is recognized that this measurement sequence may be reversed or modified, with respective modification of flow calculations, to yield the same results. It is also recognized that for low flow wells, an artificial lift system may be utilized to bring wellbore fluids to the surface for measurement. Such systems are well known in the art, and the artificial lift component may be factored into the calculations for individual flow rate to give a true measured value.

Various changes or modifications as will present themselves to those familiar with the art may be made in the method described herein without departing from the spirit of this invention whose scope is commensurate with the following claims:

What is claimed is:

1. A production evaluation method for measuring zonal production rates with said measurements being made at a surface location comprising the steps of:

measuring natural well production rates and reservoir characteristics with perturbation of flow at the surface of a wellbore using a flow measuring means, said wellbore comprising more than one producing zone and an initial steady state production rate of a process fluid within said producing zone;

isolating all fluid and blocking all fluid flow within a first wellbore production zone by a retrievable isolation means;

measuring at the surface a total well production rate with said first zone isolated, and calculating a difference in production rates and reservoir characteristics with said first zone isolated, said difference in production rates prior to and after isolation representing a zonal production rate;

repositioning the isolating means to isolate a next production zone and measuring the zonal production rate and reservoir characteristics for said next zone as the difference in well production rate and reservoir characteristics before and after said production zone isolation;

repeating said steps of repositioning, isolating, and measuring of zonal production rates and reservoir characteristics for all production zones within the wellbore.

2. The method according to claim 1 wherein the isolating means is an inflatable retrievable packer.

3. The method according to claim 1 wherein the process fluid is a natural flowing process fluid.

4. The method according to claim 1 further comprising an artificial lift mean for a low flow rate well wherein said artificial lift means provides a constant bottom hole reference pressure.

5. The method according to claim 1 wherein the isolating means is a retrievable bridge plug.

6. The method according to claim 1 wherein said process fluid is a multiphase process fluid.

7. A production evaluation method for measuring zonal production rates with said measurements being made at the surface location comprising the steps of:

measuring natural well production rates and reservoir characteristics with perturbation of flow at the surface of a well bore using a flow measuring means, said wellbore comprising more than one producing zone and an initial steady state production rate of a process fluid within said producing zone, said process fluid having more than one phase;

isolating all process fluid within a first wellbore production zone, located at a lowest interval of said wellbore, by a retrievable isolating means comprising a thru-tubing inflatable packer;

measuring at the surface a change in production rates and reservoir characteristics with said first production zone isolated, said change in production rates prior to and after isolating indicating a zonal production rate;

repositioning said isolating means to isolate a next production zone adjacent to said first production zone by deflating said packer, moving said packer up the wellbore to said next production zone, and inflating said packer;

measuring the zonal production rate and reservoir characteristics for said next zone;

repeating said steps of repositioning, isolating, and measuring of zonal production rates and reservoir characteristics for all production zones within the wellbore.

8. The method according to claim 7 further comprising the step of determining reservoir properties and formation communication of a lower production zone adjacent to a currently measured production zone, said determination comprising the measurement of reservoir properties and zonal deliverability of said lower production zone.

* * * * *